US008594337B2

(12) United States Patent
Waldmann

(10) Patent No.: US 8,594,337 B2
(45) Date of Patent: Nov. 26, 2013

(54) METHOD FOR OPERATING A HEARING DEVICE AND A HEARING DEVICE

(75) Inventor: Bernd Waldmann, Maur (CH)

(73) Assignee: Phonak AG, Staefa (CH)

( * ) Notice: Subject to any disclaimer, the term of this patent is extended or adjusted under 35 U.S.C. 154(b) by 537 days.

(21) Appl. No.: 12/518,747

(22) PCT Filed: Dec. 13, 2006

(86) PCT No.: PCT/EP2006/069640
§ 371 (c)(1),
(2), (4) Date: Jun. 11, 2009

(87) PCT Pub. No.: WO2008/071230
PCT Pub. Date: Jun. 19, 2008

(65) Prior Publication Data

US 2010/0020989 A1 Jan. 28, 2010

(51) Int. Cl.
*H04R 29/00* (2006.01)
*H04R 25/00* (2006.01)

(52) U.S. Cl.
USPC ..... 381/60; 381/23.1

(58) Field of Classification Search
USPC ..... 381/60, 150, 312, 315, 23.1
See application file for complete search history.

(56) References Cited

U.S. PATENT DOCUMENTS 5,923,764 A * 7/1999 Shennib ..... 381/60
6,167,138 A * 12/2000 Shennib ..... 381/60
6,694,034 B2 * 2/2004 Julstrom et al. ..... 381/315
2003/0044033 A1 * 3/2003 Julstrom et al. ..... 381/315
2003/0133582 A1 7/2003 Niederdrank
2008/0187145 A1 * 8/2008 Burrows et al. ..... 381/60

FOREIGN PATENT DOCUMENTS

EP 0064042 A1 11/1982
EP 0674464 A1 9/1995
EP 1443803 A2 8/2004
EP 1653773 A2 5/2006
GB 2320117 A 6/1998
WO 0122790 A2 4/2001

OTHER PUBLICATIONS

International Search Report for PCT/EP2006/069640 dated May 15, 2007.
Written Opinion for PCT/EP2006/069640 dated May 15, 2007.

* cited by examiner

*Primary Examiner* — Fan Tsang
*Assistant Examiner* — Eugene Zhao
(74) *Attorney, Agent, or Firm* — Pearne & Gordon LLP

(57) ABSTRACT

A method to operate a hearing device and a hearing device are disclosed comprising a plurality of source units (S1, . . . , Sn). The method comprises the steps of monitoring activities of the source units (S1, . . . , Sn), selecting input signals of active source units (S1, . . . , Sn), processing the selected input signals of active source units (S1, . . . , Sn), and generating an output signal of the hearing device by said processing. According to the present invention, the parameters for controlling said processing are derived from at least one active source unit (S1, . . . , Sn) and/or from at least one selected input signal, respectively. The new technology describes for the first time a hearing device comprising a plurality of source units that are dealt with in automatic manner.

18 Claims, 1 Drawing Sheet

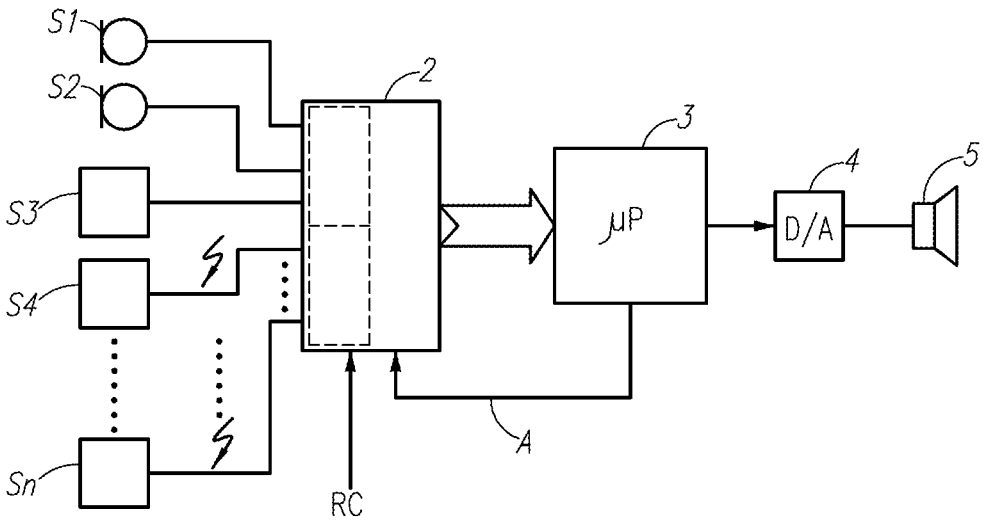
S1
S2
S3
S4
Sn
2
3
4
5
μP
D/A
A
RC

METHOD FOR OPERATING A HEARING DEVICE AND A HEARING DEVICE

The present invention is related to a method for operating a hearing device as well as to a hearing device. It is noted that under the term "hearing device" so called hearing aids, which are used to correct an impaired hearing ability of a person, as well as all others communication devices, as e.g. radio sets, must be understood. Furthermore, all other applications, as e.g. implantable devices, fall also under the term "hearing device".

Modern hearing devices can be adapted to various acoustic surround situations and/or inductive input sources with the aid of various hearing programs. Therewith, the hearing device is of use to the hearing device user in every situation. The adaptation, i.e. the switching between various hearing programs, is performed by manually activating a switch or a remote control as well as automatically with the aid of a suitable algorithm.

A method to automatically recognize a momentary acoustic surround situation or an inductive input source, and to adjust a hearing program most suitable in the determined acoustic surround situation is known from the publication of the international patent application having a publication number WO 01/22790 A2, corresponding to U.S. Pat. No. 6,895,098. The known teaching is related to a very efficient algorithm with the aid of which the acoustic surround situation can be determined with a high reliability.

A method to automatically switch between hearing programs with the aid of a fuzzy-logic controller is known from EP-0 674 464 A1, the controller being realized in analog technique.

A programmable signal processing unit is disclosed by EP-0 064 042 A1, which signal processing unit allows a manual and automatic switching between hearing programs. However, useful criteria for the switching process have not been disclosed.

EP-A2-1 653 773 discloses a technique, in which the best suitable hearing program is selected after a certain input source is selected or detected, respectively.

One object of the present invention is to further improve a method for operating a hearing device.

A method to operate a hearing device is disclosed, the method comprising the steps of:

monitoring activities of the source units, selecting input signals of active source units, processing the selected input signals of active source units, and generating an output signal of the hearing device by said processing, wherein parameters for controlling said processing are derived from at least one active source unit and/or from at least one selected input signal, respectively.

The present invention takes into account the increasing availability of personal audio devices, such as MP3 players or the like. These alternative audio inputs of active source units can be processed by the present invention as well as the microphone input signal. The input signals of the active source units, the selected input signals as well as any combination of the two types of signals can be mixed. In addition, each signal can be processed in a predefined manner in view of the superimposed signals.

In an embodiment, the present invention is further characterized by manually selecting at least one source unit.

In a further embodiment, the present invention is further characterized by automatically selecting at least one source unit.

In a further embodiment, the present invention is further characterized in that the parameters for controlling said processing are adjusted in dependence on all active source units or on all selected input signals, respectively.

In a further embodiment, the present invention is further characterized in that the parameters for controlling said processing are derived from information pertinent to a communication protocol being used to transmit the input signal. For example, the input signal received via a wireless Bluetooth link can follow one of several standardized protocols, including a headset protocol intended for mobile phone headset applications, and an advanced audio distribution protocol (A2DP), intended for listening to music. The hearing device will react to an input signal over headset profile by adjusting its processing parameters in a manner optimized for listening to telephone speech, i.e. favoring intelligibility of speech over fidelity and audibility of all signal components, and it will react to an input signal over A2DP profile by adjusting its processing parameters in a manner optimized for listening to music, i.e. favoring fidelity and audibility of all signal components over speech intelligibility.

In a further embodiment, the present invention is further characterized in that the parameters for controlling said processing are a predefined priority list of source units, wherein the active source units are processed according to the priority list.

In a further embodiment, the present invention is further characterized in that the parameter for controlling said processing is an activity state, wherein a state change from an inactive to an active state initiates said processing.

In a further embodiment, the present invention is further characterized in that the parameters for controlling said processing are obtained by analyzing and classifying the input signals into signal categories.

Furthermore, a hearing device is disclosed that comprises a plurality of source units, a selection unit for monitoring activities of the source units and for selecting input signals of active source units, a signal processing unit for processing the selected input signals of active source units, and means for generating an output signal of the hearing device, wherein parameters for controlling said signal processing unit are derived from at least one active source unit and/or form at least one selected input signal, respectively.

In an embodiment, the present invention is further characterized by means for manually selecting at least one source unit.

In a further embodiment, the present invention is further characterized by means for automatically selecting at least one source unit.

In a further embodiment, the present invention is further characterized in that the parameters for controlling said processing are adjustable in dependence on all active source units or on all selected input signals, respectively.

In a further embodiment, the present invention is further characterized in that the parameters for controlling said processing are derived from information pertinent to a communication protocol being used to transmit the input signal.

In a further embodiment, the present invention is further characterized in that the parameters for controlling said processing are a predefined priority list of source units, wherein the active source units are processed according to the priority list.

In a further embodiment, the present invention is further characterized in that the parameter for controlling said processing is an activity state, wherein a state change from an inactive to an active state initiates said processing.

In a further embodiment, the present invention is further characterized in that the parameters for controlling said processing are obtainable by analyzing and classifying the input signals into signal categories.

Further advantages become apparent to the skilled artisan from the following specific embodiments.

The only FIGURE shows a block diagram of a hearing device according to the present invention in a schematic representation.

The FIGURE schematically shows a block diagram of a hearing device. It is noted that under the term "hearing device" so called hearing aids, which are used to correct an impaired hearing ability of a person, as well as all other acoustic communication devices, as e.g. radio sets, must be understood. Furthermore, all other applications in connection with such hearing devices, as e.g. implantable devices, fall under this term.

The hearing device depicted in the only FIGURE comprises several source units S1 to Sn. The source units S1 to Sn capture audio signals, e.g. by a microphone, or receive signals from another source provider, e.g. a CD player, a MP3 player, or the like. A processing of the signals of the source units S1 to Sn is performed in a signal processing unit 3. The processed signals, i.e. the output of the signal processing unit 3, are fed to a digital-to-analog converter 4 in case the signals are processed in a digital manner in the signal processing unit 3. Finally, the output of the digital-to-analog converter 4 is connected to a receiver 5, which is a loud speaker in one embodiment or which is a mechanically stimulating device directly stimulating the acoustic organs of the human being as it is the case for implantable hearing devices.

The source units S1 to Sn can be at least one or several of the following units:

- microphones as electro-acoustic converters, including omni-directional and directional microphones;
- wired direct audio input at the hearing device via an analog or digital input;
- wireless audio input, for example via a telephone coil (T-Coil) or via a FM unit (Frequency modulated input unit, i.e. a wireless FM receiver, which is attached to the hearing device, for example) or transmission via a Bluetooth device.

In one embodiment of the present invention, the source units S1 to Sn are at least partly implemented in a selection unit 2, as it is—for example—the case for a wireless transmission of a signal to the hearing device. In such an embodiment, the hearing device comprises a receiving unit that is capable of receiving the signal transmitted by the source unit. The receiving unit is incorporated into the selection unit 2, as it is depicted in the only FIGURE by a dashed line within the selection unit 2. In a more specific embodiment, a Bluetooth device or the like is implemented in the selection unit 2—and of course in at least one of the source units S1 to Sn—in order to be able to receive an incoming signal. In general, a corresponding interface unit must be provided in the selection unit 2 or the corresponding source unit S1 to Sn in order to be able to establish a connection for signal transmission. As it is illustrated in the only FIGURE, a data transfer between one of the source units S1 to Sn and the selection unit 2 of the hearing device can either be implemented by a wireless connection or by a wired connection. Any combination between is feasible generally.

For a microphone as source unit S1 or S2, an interface unit generally is not necessary because a simple connection is only needed to connect to the selection unit 2.

The source units S1 to Sn are operationally connected to the signal processing unit 1 via the selection unit 2. For a digital hearing device, analog signals received or provided by the source units S1 to Sn are converted to digital signals in the selection unit 2. In case the received or provided signals already are in digital form, no conversion is necessary. Although the block diagram shown in the FIGURE represents a digital hearing device, it is conceivable that the present invention is also applicable for a hearing device that is completely or partly realized using analog components. For such an analog embodiment of the present invention, the analog-to-digital and digital-to-analog converters mentioned-above are not mandatory.

As source units Si to Sn one or more than one of the following units are conceivable:

- remote microphone, e.g. implemented as omni directional or directional microphone;
- home entertainment devices, as CD-(compact disc) or DVD-(digital versatile disc) player;
- portable media players, such as MP3-players or iPods;
- cellular phone;
- personal computer.

The invention is directed to a hearing device being able to connect to several source units S1 to Sn, and comprises processing capabilities to (1) determine which source units S1 to Sn are currently active, (2) enable selection of the most appropriate of all currently active source units S1 to Sn, and (3) adjust the signal processing settings depending on an assessment of the signal type currently being received through the selected source units S1 to Sn, and depending on whether the signal is received via an acoustic pathway, or via an electronic pathway.

The three steps are handled by the selection unit 2 and/or by the signal processing unit 3.

In one embodiment of the present invention, the input signals of the above-described source units S1 to Sn are continuously monitored and/or analyzed. Thereby, it is determined which source unit S1 to Sn provides an active input signal and which source unit S1 to Sn provides no active input signal. Accordingly, only active signals are being used to process an output signal for the receiver 5. This means that some of the source units S1 to Sn are being blocked from further processing and others contribute to an output signal that is fed to the receiver 5, i.e. the output signal of the hearing device.

In the following, a number of embodiments of the present invention are provided to illustrate the selection of input signals coming from the source units S1 to Sn. The selected input signals are used in the processing step performed in the selection unit 2, and possibly in the signal processing unit 3.

In a first embodiment, the hearing device senses the proximity of a magnetic field produced by, or a magnet attached to a telephone receiver to determine whether a configurable input for telephone reception, either an omnidirectional microphone or a telecoil, carries an active input signal. A processing of a signal at the telecoil (the parameter of the processing scheme) is therefore dependent on the detection of the magnetic field produced by, or the magnet attached to the telephone receiver.

In another embodiment of the present invention, the hearing device uses information pertinent to the communications protocol, such as a particular status of a particular communication layer, to determine the presence of an input signal at a source unit S1 to Sn. In addition to the detection of the presence of an input signal, also the type of the input signal is detected in a further embodiment. For example, the detected type indicates the type of headset used, or the signal type (speech, A2DP, etc.), for example.

In a further embodiment of the present invention, the automatic selection of the most appropriate of all currently active source units S1 to Sn is based on a predefined or individually configurable priority list of source units S1 to Sn.

In a further embodiment of the present invention, the hearing device always switches to the source units S1 to Sn that most recently changed from an inactive state to an active state.

In a still further embodiment of the present invention, the assessment of the input signal category is based on an analysis of the input signal itself, where the input signal may be a microphone or an electronic input source or a superposition of both. Thereby, the assessment of the input signal category can be performed in the source unit S1 to Sn itself, in the selection unit 2 or in the signal processing unit 3, i.e. the assessment can be performed in any stage in the signal path.

In another embodiment of the present invention, an assessment of an input signal category is based on information pertinent to the communications protocol used, such as the Bluetooth profile used for communication.

In a still further embodiment of the present invention, the signal processing settings used in the signal processing unit 3 are dependent on the input signal class determined by the hearing device. The signal processing settings are dependent on the acoustical quality of the signal, e.g. speech in quiet, telephone speech, speech in noise, noise and music. Furthermore, the input signal type, i.e. whether the input signal is an acoustic or an electronic signal, is also a discriminating factor for adjusting the signal processing unit 3. The signal processing settings are not dependent on the particular source unit S1 to Sn that the signal is received from.

In another embodiment, the signal processing depends on whether the input signal is (i) an acoustic input, i.e. received by a microphone co-located with the hearing device, or (ii) an electronic signal, i.e. originates at a distance in space or time, and is received via an electronic channel.

Especially for open fitting hearing devices, the signal processing settings must be different for acoustical and electronic inputs, even if the sound category is the same. For electronic inputs, there is no passive propagation of sound from the outside into the ear canal, which must be compensated with additional amplification.

In order to determine the input signal class, the output signal of the selection unit 2 that is fed to a signal processing unit 1 is additionally fed to a classification unit (not shown in the FIGURE), in which a momentary acoustic surround situation is being determined on the basis of characteristic features. Thereto, the characteristic features will be extracted during an extraction phase in the classification unit, the characteristic features being used as a basis for the classification of a momentary acoustic surround situation. Therefore, the result of this classification is the identification of the momentary acoustic surround situation or the information about the most probable momentary acoustic surround situation. According to the present invention, also information in connection with the selected source unit or source units is processed in a classification unit. Therewith, processing parameters can be selected that are most suitable to process the input signals generated or provided by the source units S1 to Sn, if necessary under consideration of the sound desired by the hearing device user.

Further information in relation to the classification or determination of acoustic surround situations can, for example, be taken from the publication of the international patent application having the publication number WO O1/22 790, which corresponds to U.S. Pat. No. 6,895,098.

In the selection unit 2, one or several active source units S1 to Sn is/are selected beside a possible analog-to-digital conversion of the signals received by the source units S1 to Sn. In addition, also interface units are provided as has already been mentioned. The selection of a source unit S1 to Sn can either take place manually, for example by the hearing device user, or automatically, for example by the signal processing unit 3. The manual selection is indicated by the operational connection denoted by RC in the FIGURE, over which operational connection, for example via a switch at the hearing device itself or via a remote control (both not depicted in the FIGURE), the hearing device or the selection unit 2 will be informed regarding which source unit or source units S1 to Sn are used. Furthermore, it is, for example, possible to inform the hearing device over the same input possibility whether the selection of the active source unit or units must take place automatically or not. The automatic selection of the source unit S1 to Sn occurs by the signal processing unit 3 and/or the selection unit 2. Therefore, the signal processing unit 3 is connected to the selection unit 2 via the connection A.

In the following, further methods are described how to automatically select one or more of the source units S1 to Sn:

A first method comprises the step of selecting a source unit S1 to Sn for which the signal noise ratio is the best.

A second method comprises the step of selecting a source unit S1 to Sn for which the incoming signal most probably has the desired signal based on features in the time or/and frequency domain.

A further possible method comprises the step of selecting a source unit S1 to Sn which generates a signal in the time and/or the frequency domain that has the highest level comparatively.

For a further embodiment of the present invention, at least a hearing program is provided for each source unit S1 to Sn, the at least one hearing program being in particular suitable for the corresponding source unit S1 to Sn. As soon as a source unit S1 to Sn is selected by the selection unit 2, the corresponding hearing program is executed in the signal processing unit 1. Therewith, the circumstance is taken into account that certain source units S1 to Sn inherently imply a certain acoustic surround situation and affect in certain circumstances even the sound, for example in the dynamic and/or frequency response. This acoustic surround situation inherently contained in the source unit S1 to Sn is considered in the corresponding hearing program.

In the following, possible processing parameters are given for individual source units S1 to Sn according to the above-mentioned list:

Source: Telephone Coil (T-Coil)

The acoustic surround situation implied herein is the following: The signal is inductively fed to the hearing device; the room acoustics is insignificant. Typically, the desired signal is rather directly taken from the source unit (for example, a voice by a microphone) or is supplied, for example, by a tape recorder or a recorded announcement. The inductive desired signal can be superimposed by inductive interference fields. Such interference fields are, for example, humming sources from transformers, coils, power cables or fluorescent tubes.

Possible remedies for reduction of the interference fields consist, for example, by the use of an interference filter that attenuates the signal level in the frequency range of the humming sources. In the acoustic signal path of the hearing device, the room acoustics cannot be improved.

A telephone coil influences the sound in such a manner that sensibility is smaller for high and low frequencies. In the intermediate frequency range, the sound is though the same as for using a hearing device microphone. For the reduction of the sounds influence by the telephone coil, the high and low frequency ranges are therefore reproduced in an amplified manner.

Source: FM-Receiver

For a FM-(frequency modulated)-receiver, the desired signal is fed to the hearing device via a FM transmission, the acoustic surround situation in the vicinity of the hearing device is therefore insignificant. Typically, a desired signal transmitted via the FM transmission is directly recorded. For example, a voice is directly recorded at the speaker's position by a remote microphone, or a band recording or a recorded announcement is set via the FM transmission. It must be pointed out that LF (low frequency) bandwidth of the transmission is limited. Therefore, it is conceivable that the sound is optimized after the transmission because of the limited bandwidth of the transmission.

Because the acoustic surround situation in the vicinity of the hearing device has no influence on the desired signal transmitted via the transmission, no measures are to be taken in the acoustic path of the hearing device.

The transmission via FM transmission typically has a low dynamic, an also limited frequency response and a higher noise as result. By raising the weak frequency ranges, an adjustment of the dynamic of the hearing device amplifier to the expected dynamic or an application of a noise suppression unit (noise cancellers), the situation can improve.

Source: Direct Audio Input

The assumed acoustic surround situation is similar to the one of a telephone coil. Possibly, a signal already transmitted via a FM transmission is fed into the hearing device via the audio input. Accordingly, the above mentioned measures apply in order to improve the desired signal.

In addition, the same measures must be taken as already described in connection with the telephone coil.

The signal fed via the audio input typically is extremely broad-band (for example, a signal from a CD player) and has a high dynamic range. Accordingly, the broad-band signals must be processed by a suitable dynamic behavior of the hearing device amplifier.

Source: Several Sources, as for Example FM Transmission and Microphone, or Microphone and Telephone Coil Basically, many situations are possible which are all characterized in that two or more sources are available. These sources can generate signals which are simultaneous or which are staggered in time. Accordingly, the amplification in the hearing device must take into account the large dynamic range to be expected in order to sustain the intelligibility. For the automatic selection of the source unit or source units S1 to Sn, a further embodiment of the present invention consists in that for a switching from one source unit S1 to Sn to another, and therewith a hearing program change from a first to a second hearing program, is carried out in such a manner that an output signal generated according to a first hearing program is smoothly turned into an output signal generated by the second hearing program. Therewith, the hearing device user is not surprised or does not feel insecure by a hard switching from a first hearing program to a second. The hearing program switching is rather only perceived by the hearing device user in that the hearing capability is steadily improved through the selection of a better hearing program. In this connection, reference is made to the publication of the international patent application having publication number WO 02/05591 A2, which corresponds to US-2003-0091197-A1, of the same applicant.

On the other hand, a sudden switching from a presently used hearing program to a new hearing program is desired for a manual triggering by the hearing device user instead of a smooth transmission, because the hearing device user perceives the sudden change in acoustics as confirmation of the switching process. A slow steady or smooth transition for a manual triggering would otherwise only result in uncertainty because it can not be determined whether the switching process has been triggered at all.

What is claimed is:

1. A method for operating a hearing device comprising a plurality of source units, the method comprising the steps of:

monitoring activities of the source units, selecting input signals of active source units, processing the selected input signals of active source units, and generating an output signal of the hearing device by said processing, wherein parameters for controlling said processing are derived from at least one selected input signal, characterized in that the parameters for controlling said processing are adjusted based on an assessment of data associated with a communication protocol being used to transmit said at least one selected input signal, wherein said assessment provides a signal type or category of said at least one selected input signal, and wherein controlling said processing comprises selecting a hearing program that corresponds to an active source unit associated with said at least one selected input signal.

2. The method according to claim 1, characterized by manually selecting at least one source unit.

3. The method according to claim 1, characterized by automatically selecting at least one source unit.

4. The method according to claim 1, characterized in that the parameters for controlling said processing are adjusted in dependence on all active source units or on all selected input signals, respectively.

5. The method according to claim 1, characterized in that the parameters for controlling said processing include a predefined priority list of source units wherein the active source units are processed according to the priority list.

6. The method according to claim 1, characterized in that a parameter for controlling said processing is an activity state, wherein a state change from an inactive to an active state initiates said processing.

7. The method according to claim 1, characterized in that the parameters for controlling said processing are obtained by analyzing and classifying the input signals into signal categories.

8. A hearing device comprising a plurality of source units, a selection unit for monitoring activities of the source units and for selecting input signals of active source units, a signal processing unit for processing the selected input signals of active source units, and means for generating an output signal of the hearing device by said signal processing, wherein parameters for controlling said processing by said signal processing unit are derived from at least one selected input signal, characterized in that the parameters for controlling said processing are adjusted based on an assessment of data associated with a communication protocol being used to transmit said at least one selected input signal, wherein said assessment provides a signal type or category of said at least one selected input signal, and wherein controlling said processing comprises selecting a hearing program that corresponds to an active source unit associated with said at least one selected input signal.

9. The hearing device according to claim 8, characterized by means for manually selecting at least one source unit.

10. The hearing device according to claim 8, characterized by means for automatically selecting at least one source unit.

11. The hearing device according to claim 8, characterized in that the parameters for controlling said processing are adjustable in dependence on all active source units or on all selected input signals, respectively.

12. The hearing device according to claim 8, characterized in that the parameters for controlling said processing include a predefined priority list of source units, wherein the active source units are processed according to the priority list.

13. The hearing device according to claim 8, characterized in that the parameter for controlling said processing is an activity state, wherein a state change from an inactive to an active state initiates said processing.

14. The hearing device according to claim 8, characterized in that the parameters for controlling said processing are obtainable by analyzing and classifying the input signals into signal categories.

15. The method according to claim 1, characterized in that the parameters for controlling said processing are derived from a communication protocol profile of the communication protocol, wherein the communication protocol profile is one of a headset profile and an advanced audio distribution profile.

16. The hearing device according to claim 8, characterized in that the parameters for controlling said processing and derived from a communication protocol profile of the communication protocol, wherein the communication protocol profile is one of a headset profile and an advanced audio distribution profile.

17. The method according to claim 1, characterized in that controlling said processing comprises adjusting frequency characteristics of the hearing device in accordance with the communication protocol being used to transmit said at least one selected input signal.

18. The hearing device according to claim 8, characterized in that controlling said processing comprises adjusting frequency characteristics of the hearing device in accordance with the communication protocol being used to transmit said at least one selected input signal.

* * * * *

UNITED STATES PATENT AND TRADEMARK OFFICE

CERTIFICATE OF CORRECTION

PATENT NO. : 8,594,337 B2
APPLICATION NO. : 12/518747
DATED : November 26, 2013
INVENTOR(S) : Bernd Waldmann It is certified that error appears in the above-identified patent and that said Letters Patent is hereby corrected as shown below:

In the Claims, column 8, line 58, please remove "signal"

Signed and Sealed this
Fourth Day of March, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,594,337 B2
APPLICATION NO. : 12/518747
DATED : November 26, 2013
INVENTOR(S) : Bernd Waldmann It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 646 days.

Signed and Sealed this
Twenty-second Day of September, 2015

Michelle K. Lee

Michelle K. Lee
*Director of the United States Patent and Trademark Office*